US005086298A

United States Patent [19]

Katsu et al.

[11] Patent Number: 5,086,298

[45] Date of Patent: Feb. 4, 1992

[54] REMOTE CONTROL SIGNAL PROCESSING DEVICE

[75] Inventors: Toshiyuki Katsu; Hidenori Hidaka; Fusako Inotsume, all of Tokyo, Japan

[73] Assignee: Pioneer Electronic Corporation, Tokyo, Japan

[21] Appl. No.: 511,886

[22] Filed: Apr. 20, 1990

Related U.S. Application Data

[63] Continuation of Ser. No. 197,249, May 23, 1988, abandoned.

[30] Foreign Application Priority Data

May 22, 1987 [JP] Japan ..... 62-123932
Jun. 30, 1987 [JP] Japan ..... 62-99458[U]

[51] Int. Cl.[5] ..... G08C 19/00

[52] U.S. Cl. ..... 340/825.69; 340/825.72; 358/194.1

[58] Field of Search ..... 340/825.69, 825.72, 340/825.56; 358/194.1; 455/186

[56] References Cited

U.S. PATENT DOCUMENTS 4,623,887 11/1986 Welles, II ..... 340/825.72
4,703,359 10/1987 Rumbolt et al. ..... 340/825.72
4,746,919 5/1988 Reitmeier ..... 340/825.72
4,771,283 9/1988 Imoto ..... 340/825.72
4,802,114 1/1989 Sogame ..... 340/825.72
4,807,052 2/1989 Amano ..... 340/825.72

*Primary Examiner*—Donald J. Yusko
*Assistant Examiner*—Michael Horabik
*Attorney, Agent, or Firm*—Sughrue, Mion, Zinn, Macpeak & Seas

[57] ABSTRACT

A remote control signal processing device includes a signal receiving unit that receives a remote control signal from a remote control apparatus, demodulating means that generates and outputs signal data corresponding to the format and code of the received remote control signal, a memory unit for storing the signal data of the received remote control signal and having storage areas associated with control signals, operating keys that are associated with the storage areas and select the storage areas, a select switch selectively sets a recording mode or an operating mode, and a control unit which, when the select switch is set into the recording mode, writes the signal data of the received remote control signal into one of the storage areas associated with a depressed one of the operating keys and which, when the select switch is set into the operating mode, sequentially reads out the loaded signal data from the memory unit for comparison with the signal data of the received remote control signal, the control unit supplying a machine with control signals associated with the storage areas where the signal data found to match the received signal data has been written.

5 Claims, 5 Drawing Sheets

REMOTE CONTROL SIGNAL PROCESSING DEVICE

This is a continuation of application Ser. No. 07/197,249 filed May 23, 1988, now abandoned.

BACKGROUND OF THE INVENTION

The present invention relates to a remote control signal processing device, more particularly to a remote control processing device for a remote control system comprising a remote control apparatus and a remotely controlled machine such as TV, VTR or audio equipment.

FIG. 1 shows conceptually two sets of remote control system consisting of two remote control apparatus and two machines that are to be remotely controlled with these apparatus. These two sets are of different types in that the code and format of the remote control signal employed by one set do not overlap those of the signal used for the other set. In other words, machine $A_1$ is remotely controlled with a remote control signal a supplied from a remote control apparatus $A_2$, whereas machine $B_1$ is remotely controlled with a remote control signal b supplied from a remote control apparatus $B_2$. However, aparatus $A_2$ is unable to remotely control the machine $B_1$, and apparatus $B_2$ is incapable of remotely controlling the machine $A_1$. Therefore, in order to remotely control two machines $A_1$ and $B_1$ in two different types of remote control system, two remote control apparatus adapted for the respective machines have to be operated but this reduces the operating efficiency of the remote control systems.

In order to deal with this low operability problem, a stack-type remote control apparatus has been proposed that is used as a single unit to remotely control a plurality of machines. This stack-type remote control apparatus is shown in FIG. 2 in which it is identified by C. The code and format of each of the remote control signals a and b from two remote control apparatus $A_2$ and $B_2$ are preloaded in the memory unit of the stack-type remote control apparatus C in storage areas associated with operating keys in this apparatus. When a certain of these operating keys are depressed, preloaded code and format are selectively used to reconstruct the associated remote control signal which is supplied to the respective machines $A_1$ and $B_1$ for controlling them remotely.

FIG. 3 is a system block diagram of stack type remote control apparatus. In order to record remote control signals, a select switch 11 is set into a reception mode and a remote control apparatus (not shown) is operated to send a remote control signal a while operating keys 12 are manipulated. The signal a is received by a reception unit 13.

The remote control signal received at the reception unit 13 is sent to a demodulating unit 14, where it is converted to signal data based on the code and format of that remote control signal and then delivered to a memory unit 15.

Manipulation of the operating keys 12 also produces associated address data from a key input unit 16 and the memory unit 15 is accessed in response to this address data so that the delivered signal data is written into this memory unit 15.

In order to perform remote control, the select switch 11 is set into a transmission mode and a certain of the operating keys 12 are manipulated, whereupon loaded signal data is read out of storage areas in the memory unit 15 that are associated with the depressed keys.

In a coding unit 17, a code and a format are set on the basis of the signal data read out from the memory unit 15 and a remote control signal is transmitted from a transmitting unit 18 in accordance with the so set code and format.

As will be understood from the above explanation, the major advantage of the stack-type remote control apparatus is that it is assembled into a single unit and that the remote-controlled devices can be operated by merely operating that one unit. However, the stack-type remote control apparatus has to store as many remote control signals as the remote control apparatuses of different types and this necessitates the use of a memory unit 15 with large storage capacity. Furthermore, the extra need to install a reception unit 13 for receiving several different remote control signals increases the size and cost of the stack-type remote control apparatus as compared with ordinary non-stack types.

Further, a conventional remote control apparatus having learning capability is shown diagrammatically in FIG. 4.

In this figure, 1 denotes a signal receiving unit that receives a remote control signal I to be learned that is transmitted from a different remote control apparatus; 2 denotes an operating key that is manipulated to read out of a memory unit 4 either the remote control signal programmed in an arithmetic processing unit 6 or the learned signal; and 3 denotes mode select switch for switching a signal reception mode to a signal transmission mode or vice versa.

Further referring to FIG. 4, the numeral 4 denotes the memory unit for storing signal elements, 5 denotes a control unit which, upon analyzing the signal received at the receiving unit 1 and comparing it with a reference signal, stores the elements of that received signal in the memory unit 4 and reads the stored signal elements from said memory unit 4 so as to reconstruct a signal, 6 denotes the arithmetic processing unit having the control unit 5, 7 denotes a display unit for displaying the sequence of operations to be executed by the remote control apparatus, and 8 denotes a signal transmitting unit from which the signal reconstructed in the control unit 5 is transmitted by a certain medium such as infrared radiation toward the machine to be controlled.

The remote control signal I to be learned may have the waveform shown in FIG. 5. The periods $T_1$–$T_4$ have different durations of On and OFF times so as to provide pulses with different duty ratios.

As shown in FIG. 6, the memory unit 4 is composed of a parameter storage section $4_1$ and a signal element storage section $4_2$. The parameter storage section $4_1$ stores the elements of the remote control signal I having the waveform shown in FIG. 5, whereas the signal composition storage section $4_2$ stores the composition of the remote control signal I. In practice, the signal composition storage section $4_2$ stores the addresses of the individual signal elements stored in the parameter storage section $4_1$.

The remote control apparatus having the composition described above will be operated in the following manner.

When the mode select switch 3 is set into a signal reception mode, the arithmetic processing unit 6 becomes ready for signal reception. Then, the remote control signal I (e.g. an IR signal) to be learned that is sent from a different remote control apparatus is detected with the reception unit 1 and converted into an electric signal for supply to the control unit 5. This control unit 5 contains a timer, a counter and a program means and measures the elements, such as the number of pulses per unit time and the time interval between pulse bursts, of the remote control signal I detected in the reception unit 1. The measured signal elements ($T_1$-$T_4$) are stored in the parameter storage section $4_1$ of the memory unit 4. The composition of the remote control signal I is stored in the signal composition storage section $4_2$ of the memory unit 4 in terms of the addresses at which the measured signal elements are stored in the parameter storage section $4_1$.

By repeating the above-described sequence of operations, erroneous reading of the remote control signal I to be learned is prevented in such a way that if the initially received and stored remote control signal I coincides with the remote control signal I received at the second time, reception date (signal elements) for the remote control signal I is stored in fixed areas of the memory unit 4 in association with the layout of operating keys 2.

The mode select switch 3 is then set into a signal transmission mode. If, in this mode, a certain of the operating keys 2 in association of which "learning" has been completed is depressed, the signal elements associated with said depressed key are read out of the memory unit 4 (consisting of the parameter storage section $4_1$ and the signal composition storage section $4_2$) under the control of the control unit 5 while, at the same time, the signal that has been learned in the manner described above is reconstructed for supply to the transmission unit 8. In the transmission unit 8, the signal reconstructed by the control unit 5 is converted to some suitable carrier signal such as IR radiation, which is sent out as an outgoing signal for controlling the operation of the machine to be controlled. The sequence of these steps is displayed on the display unit 7 under the control of the control unit 5.

Having the composition described above, the conventional remote control apparatus having the "learning" capability requires a memory unit with sufficient storage capacity to store the composition and parameters of a received signal. This remote control apparatus is not only expensive but also undesirable from a practical viewpoint since the memory unit requires a large installation area.

SUMMARY OF THE INVENTION

The present invention has been accomplished in order to solve the aforementioned problems of the prior art.

An object, therefore, of the present invention is to provide a remote signal processing device that enables a machine to be remotely controlled with a remote control apparatus of a type that is different than the remote control system in which the machine is included.

Another object of the present invention is to provide a remote control processing device for a remote control apparatus that realizes a significant reduction in the storage capacity of a parameter storage section of a memory unit by preloading time parameters in a read-only memory unit.

A remote control processing device, which is installed on a machine that performs various operation in response to a present control signals, comprises a signal receiving unit that receives a remote control signal from a remote control apparatus, demodulating means that generates and outputs signal data corresponding to the format and code of the received remote control signal, a memory unit for storing the signal data of the received remote control signal, control signal generating means that generates the control signals for operating the machine which are associated with storage areas in the memory unit, operating keys that are associated with storage areas in the memory unit and which select relevent storage area, a select switch for selectively setting a recording mode or an operating mode, and a control unit which, when the select switch is set into a recording mode, writes the signal data of the received remote control signal into a storage area associated with the depressed operating key and which, when the select switch is set into an operating mode, receives remote control signals being sent from the remote control apparatus in response to the manipulation of operating keys and sequentially reads out the loaded signal data from the memory unit for comparison with the signal data of the received remote control signal, the control unit supplying the machine with a control signal associated with the storage area where the signal data found to match the received signal data has been written.

Further, in a remote control processing device according to another aspect of the present invention, a read-only memory unit is separately provided from a memory unit for storing signal elements which is composed of a parameter storage section and a signal composition storage section, and the time parameters as signal constituent elements are preloaded in the read-only memory unit. This design is effective not only in reducing the size of the memory unit but also in improving its space factor by significantly reducing the storage capacity of the parameter storage section of the memory unit.

DETAILED DESCRIPTION OF THE PREFERRED EMBODIMENTS

Figure 8:
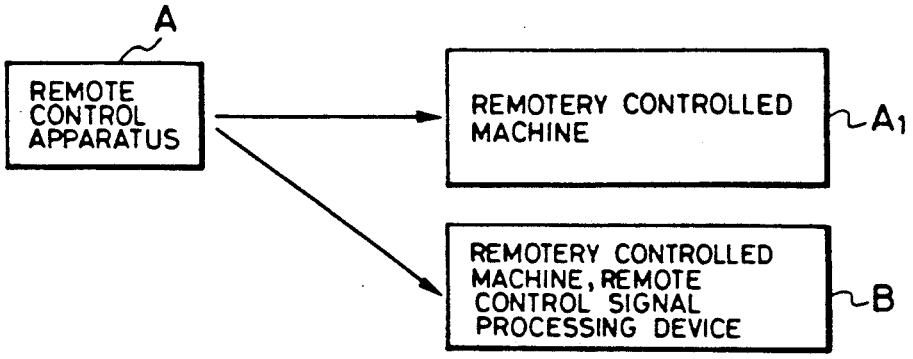
FIG. 8 shows diagrammatically a remote control system incorporating the concept of the present invention.

FIG. 8 shows conceptually a remote control system using the present invention. A remote control apparatus A which is principally intended to perform remote control on the first machine $A_1$ is also adapted to remotely control the second machine B by installing the remote control signal processing device of the present invention which is electrically connected to the machine B. The machine B is controlled with a microprocessor and other necessary devices in such a way that upon manipulation of operating keys, a preset control signal is generated in association with the depressed keys, causing the machine B to be operated in response to that control signal.

As will be described later, a similar control signal is produced from the remote control signal processing device and the machine B is operated in response to this control signal.

Figure 7:
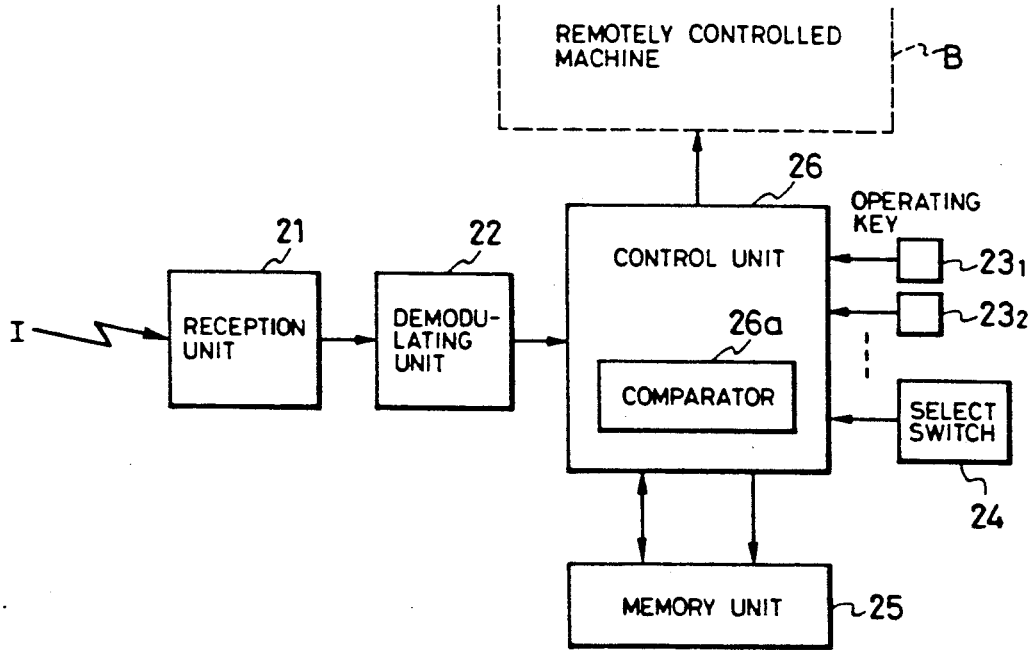
FIG. 7 is a system block diagram of the remote control signal processing device according to one embodiment of the present invention.
Figure 5:
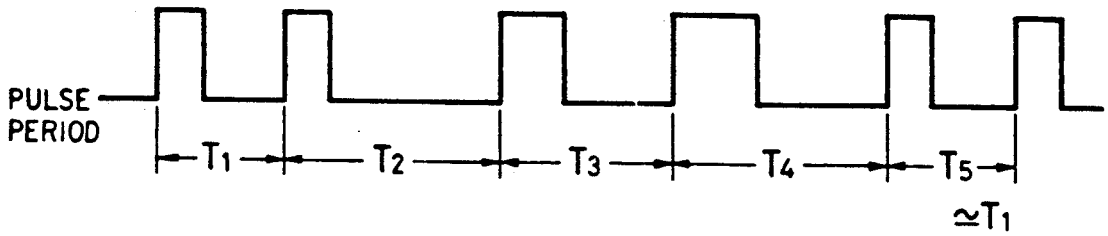
FIG. 5 is a diagram showing a typical waveform of a received signal for explaining the prior art apparatus.
Figure 6:
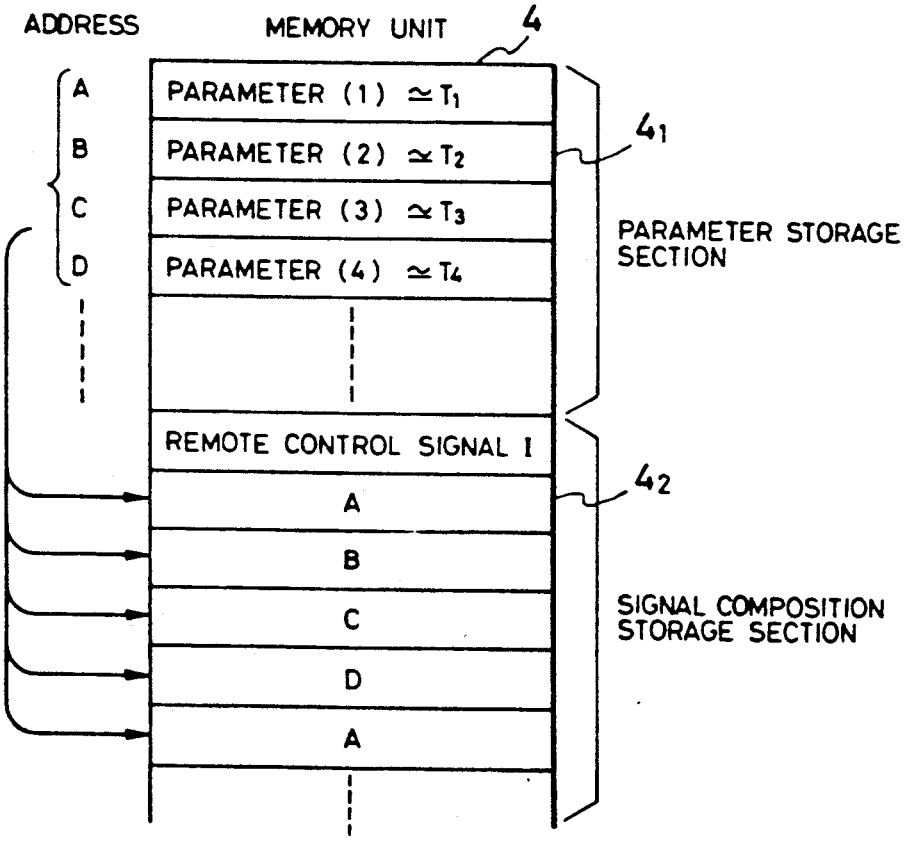
FIG. 6 PRIOR ART
FIG. 6 is a diagram showing the composition of the memory unit in the prior art system and a method of signal storage in this unit.

FIG. 7 is a system block diagram showing the remote control signal processing device according to an embodiment of the present invention which is installed on the second machine B.

In the figure, 21 is a reception unit that receives a remote control signal produced from a remote control apparatus, and 22 is a demodulating unit that generates and outputs signal data in association with the format and code of the received remote control signal.

Shown by $23_1$, $23_2$, . . . are a plurality of operating keys associated with control signals in response to which the machine to be remotely controlled is operated. As is common in the prior art, these operating keys $23_1$, $23_2$, . . . are marked with "PLAY", "STOP" and other indications that help identify the individual operations to be performed in response to the control signals associated with these keys. When the machine of interest is not to be remotely controlled, the operating keys $23_1$, $23_2$, . . . are used as ordinary keys of the type described in connection with the prior art.

Shown by 24 is a select switch that selectively activates a recording mode or an operating mode, and 25 is a memory unit for storing signal data, with storage areas (i.e., addresses) in this unit being associated with the plurality of operating keys $23_1$, $23_2$, . . . described above.

Shown by 26 is a control unit that performs programmed control of this remote control signal processing device by a microprocessor and other necessary devices. The demodulating unit 22, operating keys 23 and select switch 24 are connected to input ports (not shown) in the control unit 26. The memory unit 25 is connected to this control unit in such a way that the access of the addresses and input/output of data can be accomplished via system buses. The control unit 26 outputs control signals to a machine B through output ports (not shown). As will be described later, the control unit 26 is furnished with a comparator **26*a* that compares the signal data from the memory unit 25 with the signal data received from the demodulating unit 22**.

As will be described just below, the remote control signal processing unit is adapted to be operated in two different modes, one being a recording mode in which the signal data of a remote control signal from the remote control apparatus is recorded, and the other being an operating mode in which the machine B is remotely controlled by the remote control apparatus whose remote control signal has been recorded in the recording mode.

Recording Mode

The select switch 24 is set into a recording mode and a certain of the operating keys 23 are depressed. If, in this instance, a remote control apparatus (not shown) is operated, a remote control signal is produced, which is received at the reception unit 21 and then supplied to the demodulating unit 22 where it is converted to signal data. This signal data is inputted into the control unit 26.

The microprocessor then supplies the memory unit 25 with address data that is present in association with the depressed keys 23, and the signal data in the control unit 26 is written into the memory unit 25.

In this way, the operating keys are selectively depressed in a sequential order while remote control signals are outputted from the remote control apparatus, whereupon the signal data corresponding to the incoming remote control signals are successively recorded at the addresses in the memory unit 25 that are associated with the operating keys 23.

Operating Mode

The select switch 24 is set into an operating mode and a remote control signal is produced from the remote control apparatus. As in the recording mode, the remote control signal is received at the reception unit 21 and its signal data is supplied from the demodulating unit 22 into the control unit 26.

In the operating mode, the microprocessor accesses the memory unit 25 to successively read out the recorded signal data and compares it with the signal data supplied from the demodulating unit by the comparator **26*a***.

If, as a result of this comparison, signal data is detected, which coincides with the signal data of the received remote control signal, the operating key associated with the address from which that matching signal data has been read is detected, producing the same control signal as in the case where that operating key is normally depressed for operation of machine B. In response to this control signal, machine B performs an intended operation.

As described above, the control signals produced from the remote signal processing device in the operating mode when the remote control apparatus is manipulated, are the same as those set in association with the operating keys 23 mounted on the remote control signal processing device that have been depressed in the recording mode in association with the corresponding keys mounted on the remote control apparatus. Therefore, if a key (such as the one for performing PLAY mode) on a remote control apparatus, that is not principally intended to remotely control machine B, is correlated to the corresponding key 23 (i.e., the key marked with PLAY) on the remote control signal processing device in the recording mode, the machine B connected to this remote control signal processing device can be remotely controlled by the remote control apparatus in the same manner as it is used to control machine $A_1$.

According to the above-described embodiment of the present invention, signal data corresponding to the format and code of a received remote control signal is stored in a memory unit in association with a control signal for operating the machine to be controlled. When operating a remote control apparatus, signal data that matches the signal data of that remote control is looked up in the memory unit and a control signal that corresponds to the storage area in which said matching signal data has been written, is outputted to control the machine of interest. Therefore, the machine can be remotely controlled with a remote control apparatus which is of a different type than the remote control system for that machine.

As a further advantage, the present invention provides improved operability since a plurality of machines can be controlled with a single remote control apparatus.

Figure 1:
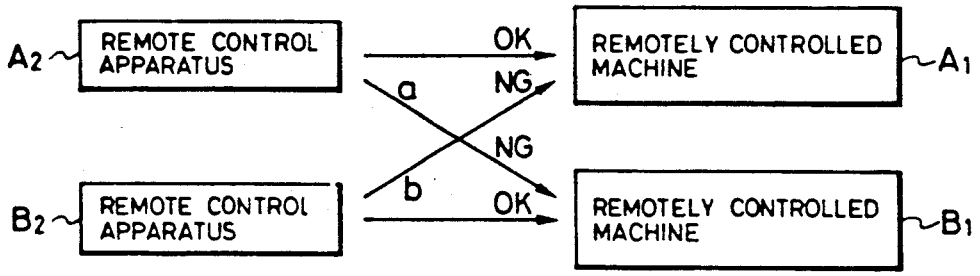
FIG. 1 PRIOR ART
FIG. 1 shows diagrammatically two different types of remote control system.
Figure 2:
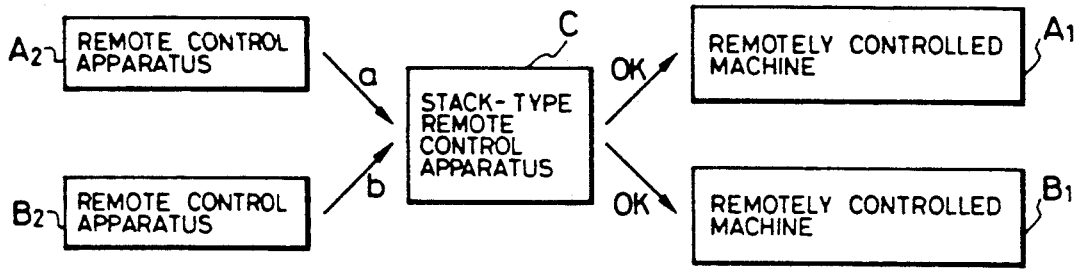
FIG. 2 PRIOR ART
FIG. 2 shows diagrammatically a remote control system employing a prior art stack-type remote control apparatus.
Figure 3:
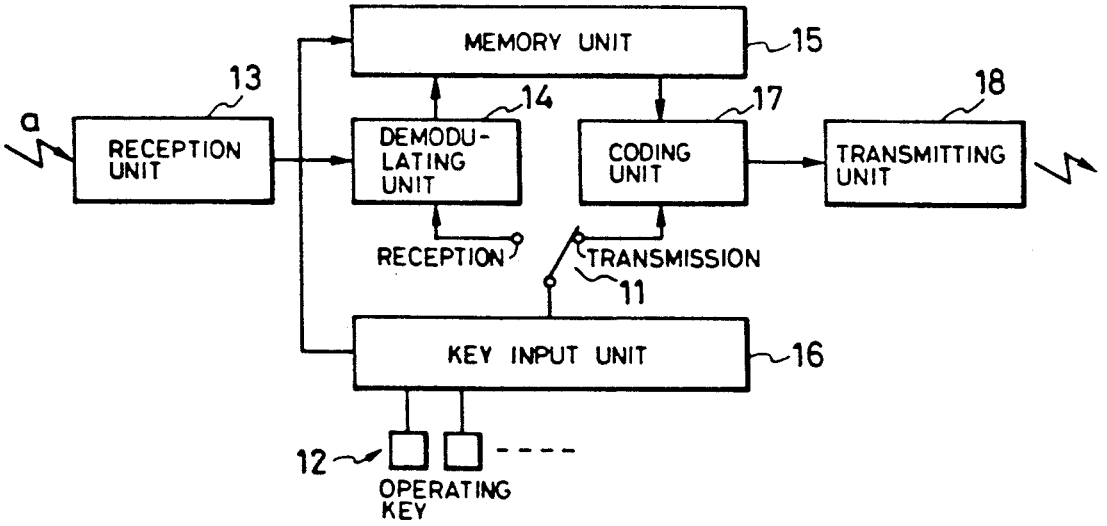
FIG. 3 PRIOR ART
FIG. 3 is a system block diagram showing the prior art stack-type remote control apparatus.
Figure 4:
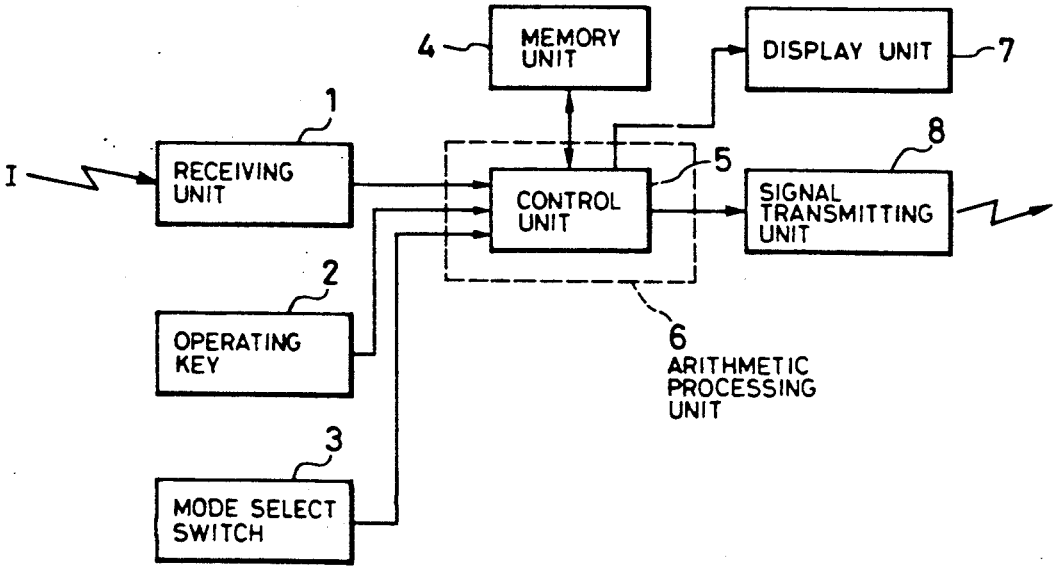
FIG. 4 PRIOR ART
FIG. 4 is a system block diagram showing a prior art remote control apparatus.
Figure 9:
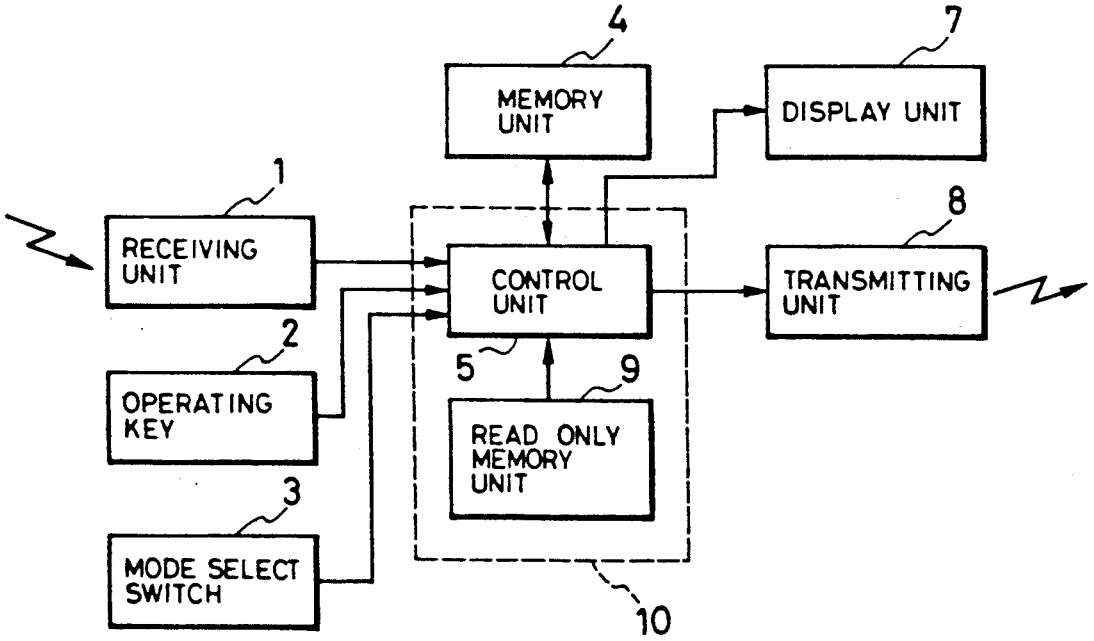
FIG. 9 is a system block diagram showing a remote control signal processing device according to another embodiment of the present invention.

FIG. 9 is a system block diagram showing a remote control processing device for a remote control apparatus according to another embodiment of the present invention. In FIG. 9, the components which are identical or equivalent to those already described in connection with the prior art shown in FIG. 4 are designated by like numerals and will not be explained in detail.

The system shown in FIG. 9 includes a ROM-composed read-only memory unit 9 preloaded with signal elements that are used in the control unit 5 to analyze and be compared with a remote control signal I tranmitted from another remote control apparatus. This read-only memory unit 9 and the control unit 5 constitute an arithmetic processing unit 10.

Figure 10:
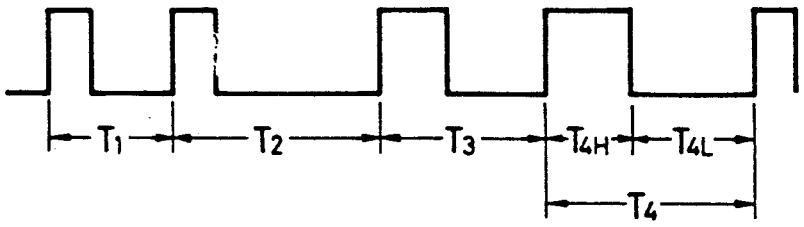
FIG. 10 is a diagram showing a typical waveform of a signal to be received by the device shown in FIG. 9.
Figure 11:
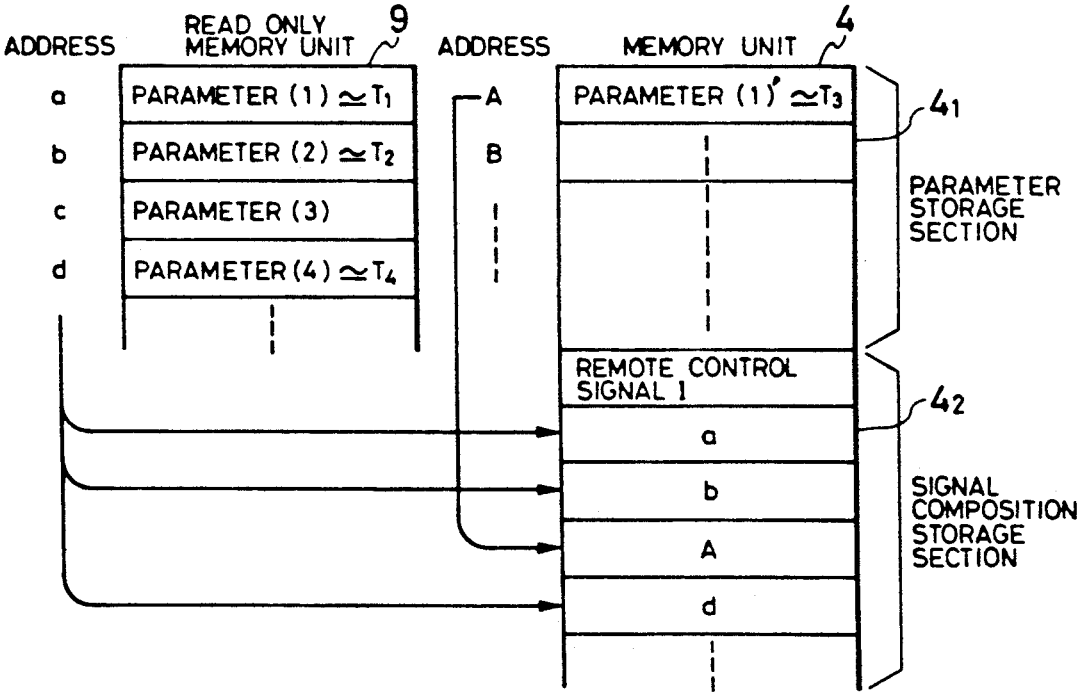
FIG. 11 is a diagram showing the compositions of a memory unit and a read-only memory unit, as well as a method of signal storage in these units.

FIG. 10 shows a typical waveform of the remote control signal I received as an incoming signal. The individual pulse periods $T_1$–$T_4$ have different on- and off-times. In case of period $T_4$, the on-time $T_{4H}$ is shorter than the off-time $T_{4L}$. The compositions of the memory unit 4 and the read-only memory unit 9 are shown in FIG. 11.

The remote control processing device for the remote control apparatus of the present invention having the composition described above will be operated in the following manner.

When the mode select switch 3 is set into a signal reception mode and the arithmetic processing unit 10 becomes ready for signal reception, the remote control signal I (e.g. an IR signal) to be learned that is sent from another remote control apparatus is detected by the receiving unit 1 and converted into an electric signal for supply to the control unit 5.

In the control unit 5, the elements or components of the remote control signal I having the waveform shown in FIG. 10 are compared with the preloaded parameters in the read-only memory unit 9 before the elements are stored in the parameter storage section $4_1$ of the memory unit 4. If the values of the elements of the received signal match or can be approximated by the preloaded parameters in the read-only memory unit 9, the signal elements are not stored in the parameter storage section $4_1$ and instead only the relevant addresses in the read-only memory unit 9 are stored in the signal composition storage section $4_2$ of the memory unit 4. If the read-only memory unit 9 does not contain any parameters that match or can be approximated by the values of the received signal elements, the relevant signal elements are stored in the parameter storage section $4_1$ and at the same time, the addresses at which they are stored in section $4_1$ are stored in the signal composition storage section $4_2$.

With reference to the case shown in FIG. 11, parameters (1) to (4) are preloaded at addresses a to d in the read-only memory unit 9. The values of the respective elements for periods $T_1$–$T_4$ of the remote control signal I shown in FIG. 10, which has been received at the control unit 5, are compared with these parameters (1) to (4).

If the value of the signal element (i.e., on-off times) for period $T_1$ is identical with or can be approximated by parameter (1), only the address a at which this parameter is stored in the read-only memory unit 9 is stored in the signal composition storage section $4_2$ of the memory unit 4. The same applies to the signal elements for $T_2$ and $T_4$ in the embodiment under consideration. If, as in the case of period $T_3$, the value of a signal element is not identical to or cannot be approximated by any of the parameters (1)–(4) stored in the read-only memory unit 9, the signal element for that period $t_3$ is stored as parameter (1)' in the parameter storage section $4_1$ of the memory unit 4 while, at the same time, the address A at which said parameter (1)' is stored in the parameter storage section $4_1$ is stored in the signal composition storage section $4_2$.

The data thus received and learned from another remote control apparatus is then stored in fixed areas in association with the layout of operating keys 2 in the manner already described in connection with the prior art. In order to control the operation of the machine of interest by sending out the learned data, the mode select switch 3 is set into a transmission mode and the learned data is reconstructed from the data read out of the memory unit 4 (composed of the parameter storage section $4_1$ and the signal composition storage section $4_2$) and the read-only memory unit 9 in the arithmetic processing unit 10 under the control of the control unit 5. The reconstructed signal is sent to the transmission unit 8 where it is converted to a carrier signal such as IR signal, which then is transmitted to the machine to be controlled.

The above-described embodiment of the present invention relates to the case where a remote control signal is to be learned. It should, however, be noted that the principal advantage of the present invention, namely, the maximum reduction in the storage capacity of the memory unit, can be attained in all cases where the signal to be learned is a data set that is composed of predictable parameters.

As described above, the remote control processing device for the remote control apparatus according to the embodiment of the present invention includes a separate read-only memory unit that is to be preloaded with time parameters as signal constituent elements. This is effective not only in reducing size of the memory unit but also in improving its space factor by significantly reducing the storage capacity of the parameter storage section of the memory unit.

What is claimed is:

1. In a remote control signal processing device for a machine that performs various operations in response to preset control signals, the device being of the type comprising:

a signal receiving unit for receiving a remote control signal from an external remote control apparatus;

demodulating means for generating and outputting signal data corresponding to the format and code of the received remote control signal;

a memory unit for storing the signal data of the received remote control signal, said memory unit including storage areas which are associated with said preset control signals;

operating keys, associated with said storage areas in said memory unit, for selecting said storage areas; and a select switch for selectively setting a recording mode or an operating mode of the device; the improvement comprising;

a control unit which, when said select switch is set into said recording mode, writes the signal data of the received remote control signal into one of said storage areas associated with a manipulated one of said operating keys, said control unit including comparator means, and said control unit operable, when said select switch is set into said operating mode, for sequentially reading out the written signal data from said memory unit, and said comparator means operable for comparing the sequentially read out written signal data with the signal data of the received remote control signal, said control unit supplying said machine with the preset control signal associated with the storage area where the signal data, which has been found to match the received signal data by the comparison performed by said comparator means, has been written.

2. In a remote control signal processing device for a remote control apparatus having the ability to learn in such a way that it receives and stores a signal transmitted from a different remote control apparatus and that it transmits said stored signal to control the operation of a machine to be controlled the device being of the type comprising:

a memory unit composed of a parameter storage section for storing elements of the received signal; and a select switch for selectively setting a receiving mode or a transmitting mode of the processing device; the improvement comprising a read-only memory unit that stores predetermined element data representing elements commonly found in signals transmitted from a remote control apparatus, said memory unit including a signal composition section; and a control unit which, in said receiving mode, analyzes the received signal to form signal elements representing the received signal, compares the signal elements with the element data stored in said read-only memory unit, writes the elements of said received signal into said parameter storage section and writes addresses of said parameter storage section storing the elements into said signal composition storage section when the elements of said received signal do not match or cannot be approximated by the element data stored in said read-only memory unit, said control unit writes only addresses of said read-only memory unit storing said element data when the elements of said received signal match or can be approximated by the element data stored in said read-only memory unit, said control unit reads said signal elements from said memory unit and said read-only memory unit to reconstruct the received signal in said transmitting mode.

3. The remote control signal processing device according to claim 2, wherein the signal elements and the stored element data comprise on-off pulse times for different periods, the on-off pulse times for the different periods representing a remote control signal.

4. The remote control signal processing device according to claim 3, wherein the read-only memory unit comprises a plurality of storage locations, each of said storage locations containing predetermined data representing an on-off pulse time corresponding to one of said different periods.

5. The remote control signal processing device according to claim 2, wherein said read-only memory unit stores predetermined data representing different pulse periods, each of the stored pulse periods having a different on-off time.

* * * * *